US005776048A

United States Patent [19]

Jo

[11] Patent Number: 5,776,048

[45] Date of Patent: Jul. 7, 1998

[54] SYSTEM FOR TREATING BURN SUFFERERS

[76] Inventor: Sung Kee Jo, 29-1, Hwykyung-Dong, Dongdaemoon-Ku, Seoul, Rep. of Korea

[21] Appl. No.: 612,686

[22] Filed: Mar. 8, 1996

[30] Foreign Application Priority Data

Mar. 9, 1995 [KR] Rep. of Korea ..... 1995-4835

[51] Int. Cl.[6] ..... A61G 10/00

[52] U.S. Cl. ..... 600/21

[58] Field of Search ..... 600/21–22; 128/897–98

[56] References Cited

U.S. PATENT DOCUMENTS 3,490,443 1/1970 Decupper ..... 600/21

5,308,310 5/1994 Roff et al. ..... 600/21

FOREIGN PATENT DOCUMENTS 1674836 9/1991 U.S.S.R. ..... 600/21

*Primary Examiner*—John P. Lacyk

*Attorney, Agent, or Firm*—Nawrocki, Rooney & Sivertson, P.A.

[57] ABSTRACT

An integrated system for treating burn sufferers is disclosed. The system reduces the pressured clean isolation into a compact size. The system is easily installed and moved at any time to any place without being restricted by time and space. The system also achieves compactness and lightness of the facilities of the pressured clean isolation, such as the air cleaning system, room warming system, room cooling system, humidity controller, anti-sore bed and bathing tank. The above facilities are organically composed into the capsuled system. The system has a bed having fixed and movable bed surfaces which alternatively hold a burn sufferer. The bed is selectively sealed by a sealing cap thereby being capsuled. A movable bathing tank is placed under the bed. An air and water treating and supplying unit is connected to the sealing cap and supplies clean air and purified water for the capsuled bed.

12 Claims, 9 Drawing Sheets

SYSTEM FOR TREATING BURN SUFFERERS

BACKGROUND OF THE INVENTION

1. Field of the Invention

The present invention relates in general to a medical instrument for treating burn sufferers. Particularly, this invention integrates several instruments, necessarily used in treating burn sufferers, into a single system with a small, light, simple and compact construction suitable to save space, be convenient to the users, be easily manufactured at a lower cost and effectively treat the burn sufferers.

2. Description of the Prior Art

In order to treat burn sufferers, it is necessary not only to prevent the capillary vessels of the burnt skin from becoming infected but also to protect the burnt skin from toxic materials thereby preventing conditions from growing worse. In order to achieve the above object, a pressured clean isolation equipped with the following facilities has been preferably used.

1. Air cleaning system:

The air in the pressured clean isolation must be free from any type of toxic gas as well as bacterial impurities. In order to keep the air of the pressured clean isolation very clean, the pressured clean isolation must be supplied with clean air which has been treated by a VEPA filter (very high efficiency air filter) suitable to filter off minute particles of not larger than 0.1 μm in diameter. In addition, the ventilation ratio of the pressured clean isolation must not be less than 5/h.

In order to reliably protect the pressured clean isolation from external air, it is necessary to keep the room pressure of the pressured clean isolation higher than the atmospheric pressure by about 1 or 2 atm. In order to achieve the above object, the pressured clean isolation must be equipped with a noiseless and high quality blower and ventilator.

2. Room warming system:

In order to treat a burn sufferer using the pressured clean isolation, it is required to thoroughly remove the sufferer's clothes. In this regard, the pressured clean isolation must be equipped with a room warming system which maintains the body heat of the burn sufferer. In addition, the pressured clean isolation must be equipped with an automatic control system which maintains the appropriately-adjusted temperature of the room.

3. Room cooling system:

In order to either cool the pressured clean isolation in the summer season or to reduce the body heat of the burn sufferers as demands, the pressured clean isolation must be equipped with a room cooling system. In addition, the pressured clean isolation must be equipped with an automatic control system which maintains the appropriately-adjusted temperature of the room.

4. Humidity controller:

When the indoor air of the pressured clean isolation is exceedingly dry, dryness of wounds of the burn sufferers is promoted thereby easily cracking and shrinking the regenerated skin. In this regard, it is required to install a humidity controller to the pressured clean isolation for appropriately adjusting the humidity of the room. The pressured clean isolation must be additionally equipped with an automatic control system which maintains the appropriately-adjusted humidity of the room.

5. Anti-sore bed:

The burn sufferers must be treated for a long time while lying in bed. In the case of a burn sufferer who must be in bed for a long time on one's wounds, it is necessary to consider sores.

In order to prevent such sores of the burn sufferers, the burn sufferers need to lie in a circle bed with an air-mattress.

6. Bathing tank:

In order to give a burn sufferer a water massage to smooth blood circulation about wounds or to easily redress bandages, the burn sufferer must repeatedly take a bath with warm water. Therefore, the pressured clean isolation must be equipped with a bathing tank.

The above bathing tank has to be provided with an automatic control system which maintains the appropriately-adjusted water temperature.

As described above, the pressured clean isolation for treating burn sufferers must be equipped with several facilities.

The hospitals in developed countries are equipped with the pressured clean isolation with the above facilities which are necessarily used for treating the burn sufferers. However, most hospitals in underdeveloped or developing countries have not been equipped with the above pressured clean isolation.

The increasing rate of burn sufferers in underdeveloped or developing countries is relatively higher than that of developed countries. For example, the number of burn sufferers in Korea has gradually increased at the rate of about 17–20% every year due to fires and industrial disasters. The above increase rate of Korean burn sufferers is very high in comparison with that of more developed countries.

However, the death rate of burn sufferers in underdeveloped or developing countries is two to three times that of more developed countries since most hospitals in underdeveloped or developing countries are not equipped with the above pressured clean isolation necessarily used for treating burn sufferers. Death rate of Korean burn sufferers caused by blood poisoning is about 73%. The time period for treating burn sufferers in underdeveloped or developing countries is extended by 30% on the average in comparison with more developed countries and thereby gives the burn sufferers much pain and increases treatment costs.

The above problems have been caused by the fact that most hospitals in underdeveloped or developing countries have not been equipped with the pressured clean isolation with the above facilities necessarily used for treating the burn sufferers.

The burn sufferers in underdeveloped or developing countries are almost all indigent and want to leave the hospital early to avoid hospital charges. In this regard, most hospitals in those countries fail to increase medical charges while treating the burn sufferers thereby evading the above pressured clean isolation. In addition, the above facilities of the pressured clean isolation must be installed in the hospitals when they are built. The facilities also must be operated by a central air conditioning and heating system, so there is a restriction in moving, newly installing and installing more facilities. Furthermore, much money must be required in order to install and manage the above facilities, so most hospitals in underdeveloped or developing countries evade the above facilities.

In this regard, it necessary to provide a system which effectively treats burn sufferers and is easily installed in hospitals at a low cost and effectively managed.

SUMMARY OF THE INVENTION

It is, therefore, an object of the present invention to provide a system for treating burn sufferers in which the above problems can be overcome and which reduces the pressured clean isolation into a compact size of a conventional medical bed which is easily installed and moved at any time and to any place without being restricted by time and space thereby being convenient to the users and reducing the cost for installing and managing the pressured clean isolation.

It is another object of the present invention to provide a system for treating burn sufferers which achieves compactness and lightness of the facilities of the pressured clean isolation such as the air cleaning system, room warming system, room cooling system, humidity controller, anti-sore bed, bathing tank and organically connects the facilities to the capsuled pressured clean isolation, thereby structurally composing the facilities of the pressured clean isolation into a simple and compact structure and maximizing the operational reliability.

In order to accomplish the above objects, a system for treating burn sufferers in accordance with the present invention comprises: a rectangular holder having a top frame, a pair of side frames and a bottom support panel; a bed horizontally placed between the side frames, the bed having a fixed bed surface and movable bed surface, the fixed and movable bed surfaces alternatively holding a burn sufferer, the movable bed surface being selectively moved by a first drive means thereby being selectively lifted up higher than the fixed bed surface; a movable sealing cap movably mounted to the holder for selectively sealing the bed and thereby capsuling the bed, the sealing cap being vertically moved by a second drive means; a movable bathing tank placed under the bed and selectively vertically moved by a third drive means; and an air and water treating and supplying unit connected to the sealing cap and adapted for supplying both clean air with appropriate temperature and humidity and purified water for the bed sealed by the sealing cap.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
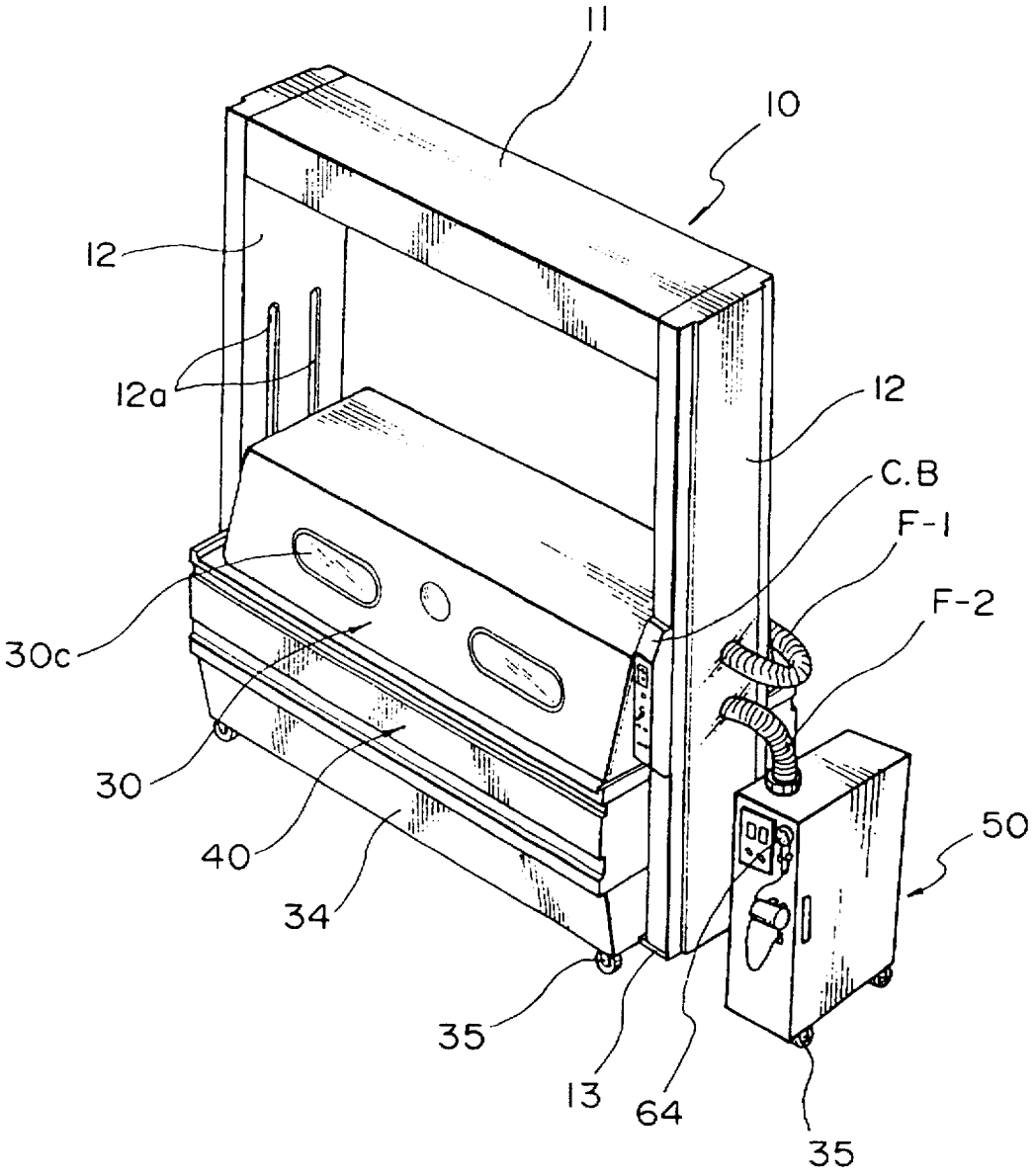
FIG. 1 is a perspective view of a treating system in accordance with a preferred embodiment of the present invention.

FIG. 1 is a perspective view of a treating system in accordance with a preferred embodiment of the present invention. As shown in the drawings, the treating system includes a rectangular holder 10 which comprises a top frame 11, a pair of side frames 12 and a bottom support panel 13. The above frames 11 and 12 use hollow frames. A bed 20 having a conventional medical bed size is horizontally placed between the two side frames 12. The system also includes a movable sealing cap 30 and bathing tank 40 which are placed above and below the bed 20 respectively and are vertically movable relative to the side frames 12. The above system further includes an air and water treating and supplying unit 50. The above unit 50 not only treats air in order to supply clean air with appropriate temperature and humidity to the cap 30, it also purifies water and supplies the bathing tank 40 with purified warm water.

Figure 6B:
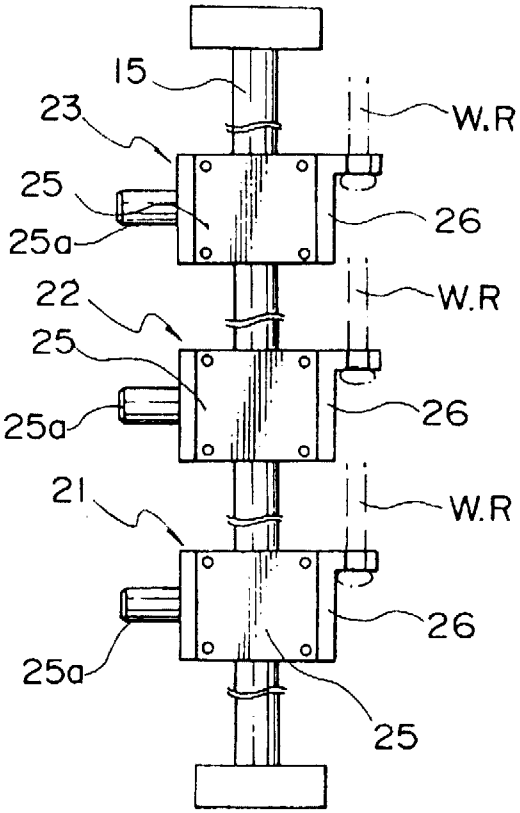
FIGS. 6*a* and 6*b* enlarged side and front views showing the construction of a guide mechanism for guiding the movement of the sealing cap, bathing tank and bed of the above system, respectively.
Figure 6A:
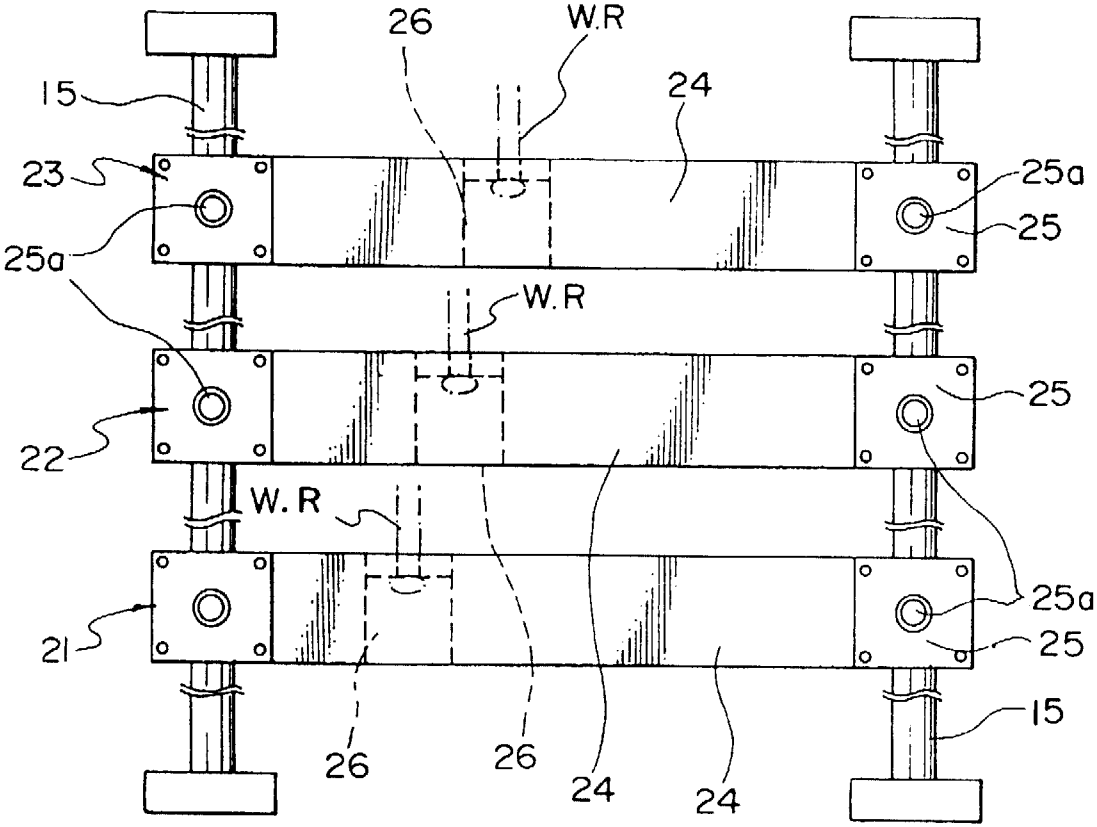

In the above rectangular holder 10, a three-stepped guide roll 14 is fitted over a shaft inside the top end of each side frame 12. Placed in the top frame 11 extending between the side frames 12 is a plurality of drive units, that is, a cap drive unit 17, bed drive unit 18 and a bathing tank drive unit 19. The vertical positions of the above drive units 17, 18 and 19 in the top frame 11 are different from each other. A pair of guide rods 15 vertically stand in each side frame 12 such that the rods 15 are spaced apart from and are parallel with each other. Each guide rod 15 vertically extends from the bottom panel 13 upward. As shown in FIGS. 6*a* and 6*b*, a plurality of guiders, that is, a bed guider 21, bathing tank guide 22 and cap guider 23, are movably coupled to the guide rods 15. Each guider 21, 22 or 23 comprises a pair of horizontal connection bars 24 and a pair of sliding blocks 25 mounted to both ends of each bar 24. The above guiders 21, 22 and 23 are movably coupled to the guide rods 15 through the sliding blocks 25. The above connection bars 24 are provided with guide brackets 26 at different horizontal portions of the bars 24. A wire rope WR, which is wrapped about the guide roll 14 and passes over one of the drive units 17, 18 and 19, is connected to an associated bracket 26 of the above bars 24.

A pair of longitudinal guide holes 12*a* are formed on each side frame 12 of the holder 10. The sliding blocks 25 of each guider 21, 22 or 23 are provided with connection rods 25*a*, respectively. The above connection rods 25*a* pass through the guide holes 12*a* of the side frames 12 and project out of the holes 12*a*.

Figure 7A:
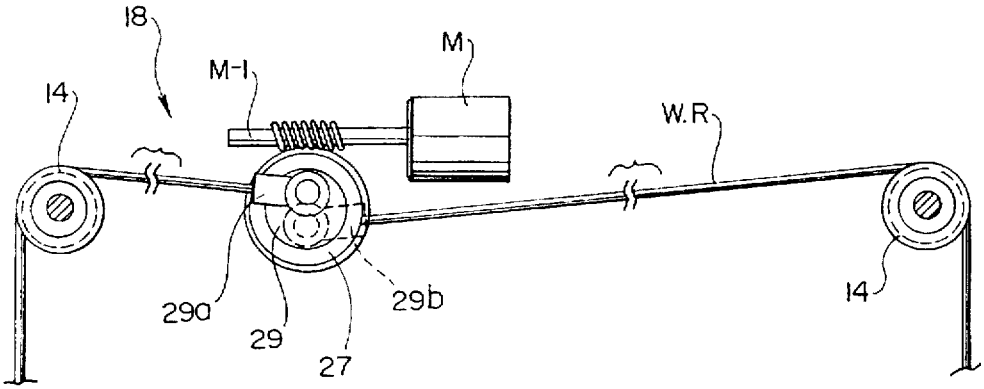
FIGS. 7*a* and 7*b* are front and plan views showing the construction of a drive unit for driving the bed of the above system, respectively.
Figure 7B:
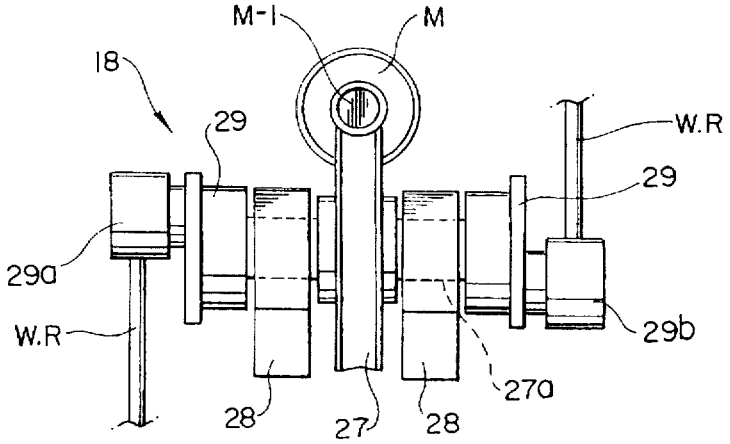

As shown in FIGS. 7*a* and 7*b*, the above bed drive unit 18 includes a worm wheel 27 which gears into the worm shaft M-1 of a drive motor M. The above worm wheel 27 is held between a pair of fixed bearings 28 by a central shaft 27*a*. The above bearings 28 are fixed to the top frame 11 of the holder 10. A pair of driven wheels 29 are fixed to both ends of the above central shaft 27*a*. Each of the above driven wheels 29 is provided with an eccentric connection member 29*a* which in turn is connected to the wire rope W.R extending from the bed guider 21.

Figure 8A:
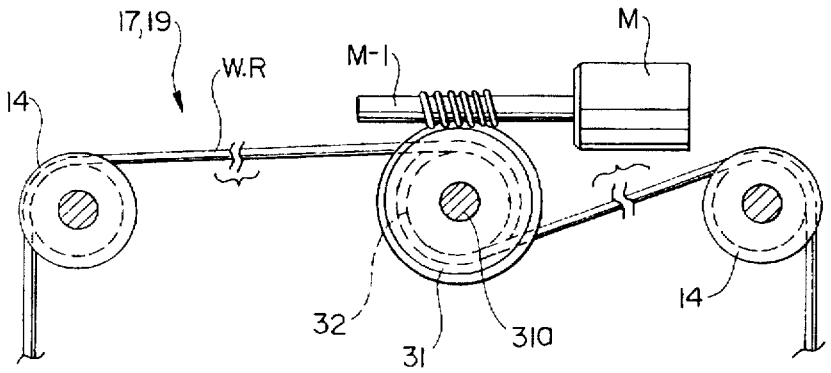
FIGS. 8*a* to 8*c* views showing the construction of one of the drive units for driving the sealing cap and bathing tank of the above system, respectively.
Figure 8B:
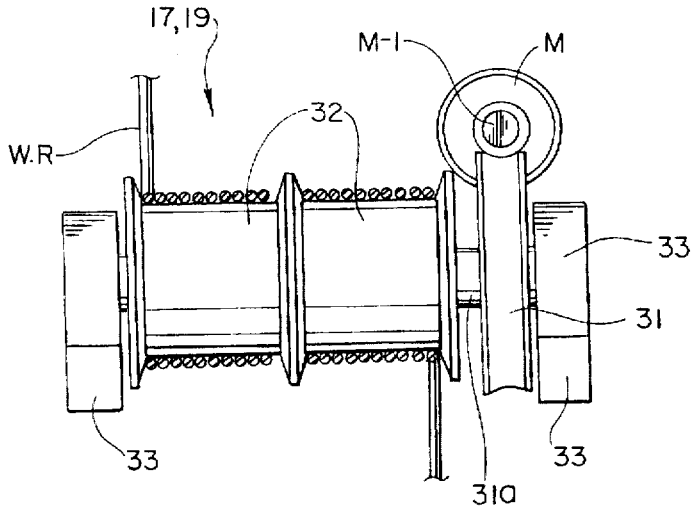
Figure 8C:
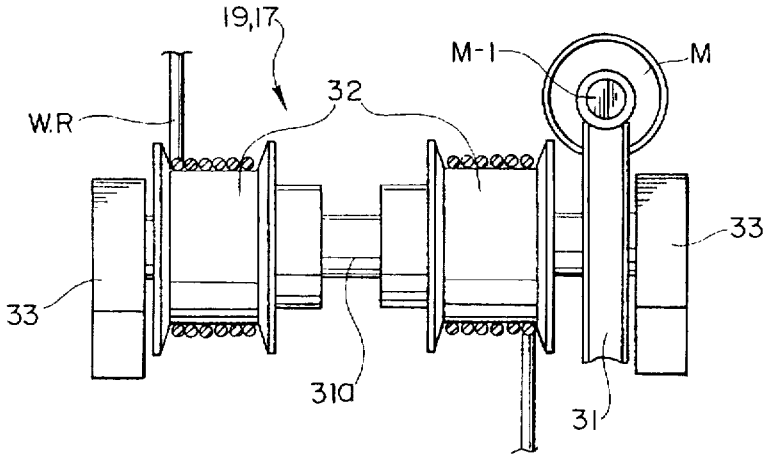

The cap drive unit 17 and bathing tank drive unit 19 have the same construction, so the construction of the above drive units 17 and 19 is shown in FIGS. 8*a* to 8*c*. As shown in the drawings, each drive unit 17 or 19 includes a worm wheel 31 which gears into the worm shaft M-1 of a drive motor M. The above worm wheel 31 is fixed to a side of a take-up drum 32 which is partitioned into two parts. The above worm wheel 31 is held between a pair of fixed bearings 33 by a central shaft 31*a*. The above bearings 33 are fixed to the top frame 11 of the holder 10. The above worm wheel 31 thus winds or unwinds the rope W.R on or from the take-up drum 32, thereby vertically moving the sealing cap or bathing tank relative to the side frames 12.

In the above drive units 17 and 19, the take-up drums 32 have different widths in order to prevent interference between the take-up drums 32 of the units 17 and 19 while winding the wire ropes W.R.

A rectangular protection tub 34 is fixedly provided on the above bottom panel 13 of the holder 10. The above tub 34 opens upward. The four inside corners of the above rectangular tub 34 are provided with casters 35, respectively.

Figure 2:
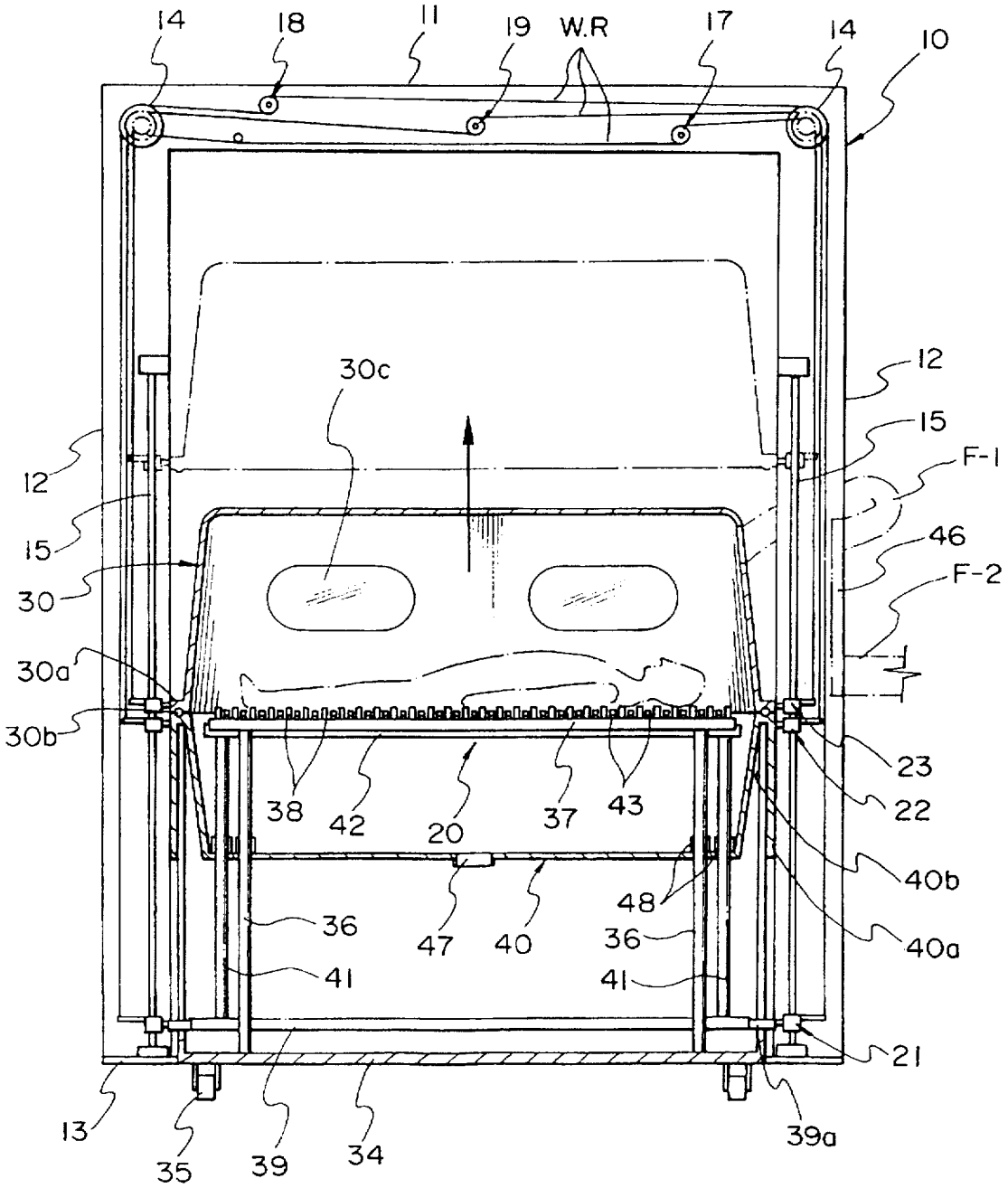
FIG. 2 is a sectional view of the above system, showing the vertical movement of a movable sealing cap.

As shown in FIG. 2, the bathing tank 40 is seated on and held by the tub 34 on its seat groove 40*b* which is formed by a bent edge 40*a* of the tank 40. Both side portions of the above bent edge 40*a* of the bathing tank 40 are connected to the connection rods 25*a* of the sliding blocks 25 of the bathing tank guider 22.

In the bed 20, a plurality of vertical rods 36 extend from the bottom of the tub 34 upward and penetrate the bottom of the bathing tank 40. The top ends of the above vertical rods 36 are connected to each other by a plurality of horizontal rods 37. A plurality of fixed bars 38 are mounted on the horizontal rods 37 and are spaced out at regular intervals thereby forming a fixed bed surface with regularly-spaced slits. In addition, a plurality of partition bars 43 are fixed to horizontal bars 42 thereby forming an additional bed surface suitable for preventing bed sores. The above partition bars 43 are placed between the above fixed bars 38 such that the normal vertical position of the partition bars 43 is lower than the fixed bed surface formed by the fixed bars 38. The above horizontal bars 42 are connected to operating rods 41 which stand on an operating plate 39. The operating plate 39 is mounted to the inner bottom of the protection tub 34. A plurality of protrusions 39*a* are provided on the corners of the operating plate 39. The above protrusions 39*a* pass through the guide slots 34*a* formed on both sides of the above protection tub 34. The protrusions 39*a* in turn are connected to the connection rods 25*a* of the sliding blocks 25 of the bed guider 21.

Figure 5:
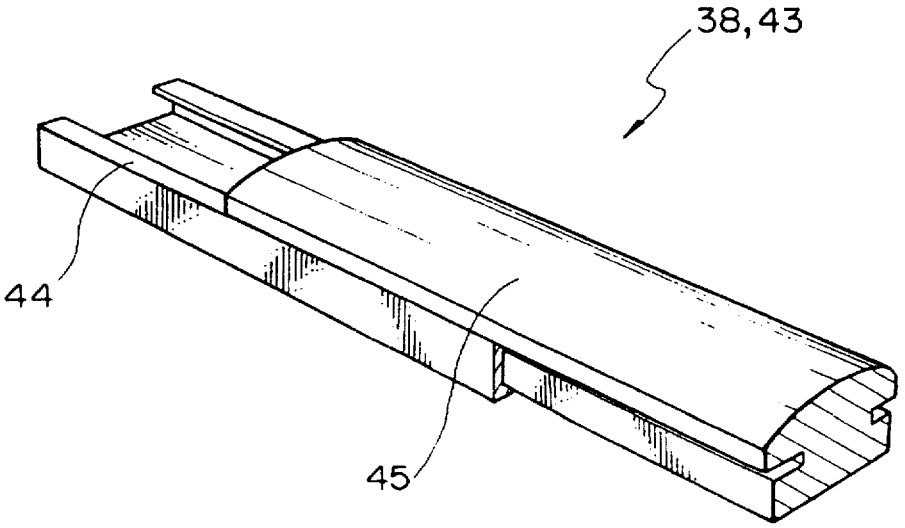
FIG. 5 is an enlarged perspective view showing the coupling structure of a bar of the above bed.

As shown in FIG. 5, each of the fixed bars 38 and partition bars 43 is constructed in a separating type suitable to be washed or sterilized. That is, each bar 38 or 43 comprises a separating bar 45 and holding bar 44 which are detachably assembled together. In this regard, the separating bar 45 is separated from the holding bar 44 in order to wash and sterilize the bars 38 and 43 as demands. The top surface of the above separating bar 45 is smoothly rounded.

The above sealing cap 30 has a bottom edge 30*a* having the same size as that of the top surface of the bent edge 40*a* of the bathing tank 40. The above bottom edge 30*a* of the sealing cap 30 forms a sealing pad 30*b*. The sealing cap 30 also includes at least one transparent window 30*c* suitable for easily checking the interior of the cap 30 from the outside. Both sides of the bottom edge 30*a* of the cap 30 are connected to the connection rods 25*a* of the sliding blocks 25 of the cap guider 23.

A first bellows pipe F-1 is connected to one side wall of the sealing cap 30 in order to communicate with the interior of the cap 30. The other end of the above bellows pipe F-1 is connected to a connection pipe 46. The connection pipe 46 extends in the left-handed frame 12 of the holder 10. The above pipes F-1 and 46 are connected together outside the frame 12. The other end of the above connection pipe 46 is connected to a second bellows pipe F-2. The above pipe F-2 extends from an air and water treating and supplying unit 50.

Figure 9:
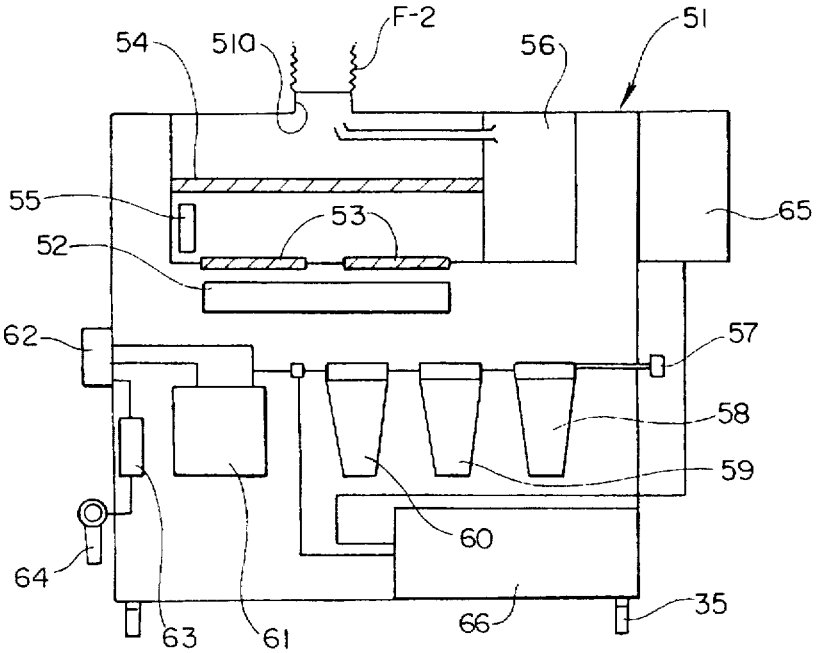
FIG. 9 is a schematic view showing the construction of an air and water treating and supplying unit of the above system.

The construction of the above air and water treating and supplying unit 50 is shown in FIG. 9. As shown in the drawing, the above unit 50 cased by a movable housing 51. The housing 51 is provided with casters 35 on its bottom thereby being movable. The above housing 51 has an outlet port 51*a* through which the unit 50 is connected to the second bellows pipe F-2.

The above housing 51 also includes a blower 52 which forcibly circulates external air toward the outlet port 51*a*. The external air flowing toward the outlet port is repeatedly filtered by first and second air filters 53 and 54. A heater 55 heats the external air while the air passes through the filters 53 and 54. In addition, the housing 50 includes a humidity controller 56 which controls air with appropriate humidity. In order to purify water, first to third water filters 58, 59 and 60 are provided in the housing 51. The above water filters 58, 59 and 60 are connected to a water inlet pipe 57 thereby repeatedly filtering the water supplied thereto through the water inlet pipe 57. The purified water of the above water filters in turn is heated up by a heater 61. A mixing valve 62 adjusts the heated water thereby providing warm water having an appropriate temperature. The above housing 51 further includes a massage cycler 63 which supplies the warm water to a shower system 64 at an appropriate cycle. An acid water tank 65 is connected to a pump 66. The above acid water tank 65 supplies acid water effective on stability of human body and sterilization. The pump 66 is also connected to a water supply line extending from the third water filter 60.

In the drawings, the reference numerals 47 and 48 denote a drain port and sealing ring respectively, while the reference character C.B denotes a control board.

The operational effect of the above treating system will be described hereinbelow.

The sealing cap 30 is lifted up by operating the control board C.B thereby opening the bed 20 as shown in FIG. 2. The sealing cap 30 in the above state is operated by the cap drive unit 17. That is, the drive motor M of the above drive unit 17 starts to generate the rotating force thereby rotating the worm shaft M-1 as shown in FIGS. 8*a* to 8*c*. The worm wheel 31 rotates about the central shaft 31*a* in order to rotate the take-up drum 32.

As a result of the rotating motion of the above drum 32, the wire rope W.R is wound on the drum 32 thereby lifting the sliding blocks 25 of the sealing cap guider 23 along the guide rods 15 inside the side frame 12. The sealing cap 30 whose edge 30*a* is connected to the connection rods 25*a* of the sliding blocks 25 is thus lifted up at the same time.

After opening the bed 20 by lifting the sealing cap 30, a burn sufferer lies in the bed 20. Thereafter, the drive motor M of the cap drive unit 17 rotates in the reverse direction. The sealing cap 30 thus moves down along the guide rods 15 until the sealing pad 30*b* of the cap's bottom edge 30*a* comes into close contact with the top surface of the bent edge of the bathing tank 40 thus forming a capsuled pressured clean isolation.

Thereafter, the air and water treating and supplying unit 50 is operated to supply clean air with the appropriate temperature and humidity to the burn sufferer in the capsuled bed 20. The air in turn is discharged from the capsuled bed 20 through the drain port 47 of the bathing tank 40. The capsuled bed 20 thus becomes a sterilized isolation. Due to the supply of the clean air for the capsuled bed 20, the burn sufferer in the bed 20 has no difficulty in breathing while being completely protected from being infected and coming into contact with toxic materials. Therefore, the above system completely protects the burn sufferer from blood poisoning which is a serious cause of death of the burn sufferers. The above system is thus effective for treating the burn sufferers.

The burn sufferers must be treated for a long time while lying in bed. A burn sufferer who must be in bed for a long time on one's wounds is apt to have sores on the wounds.

Figure 3:
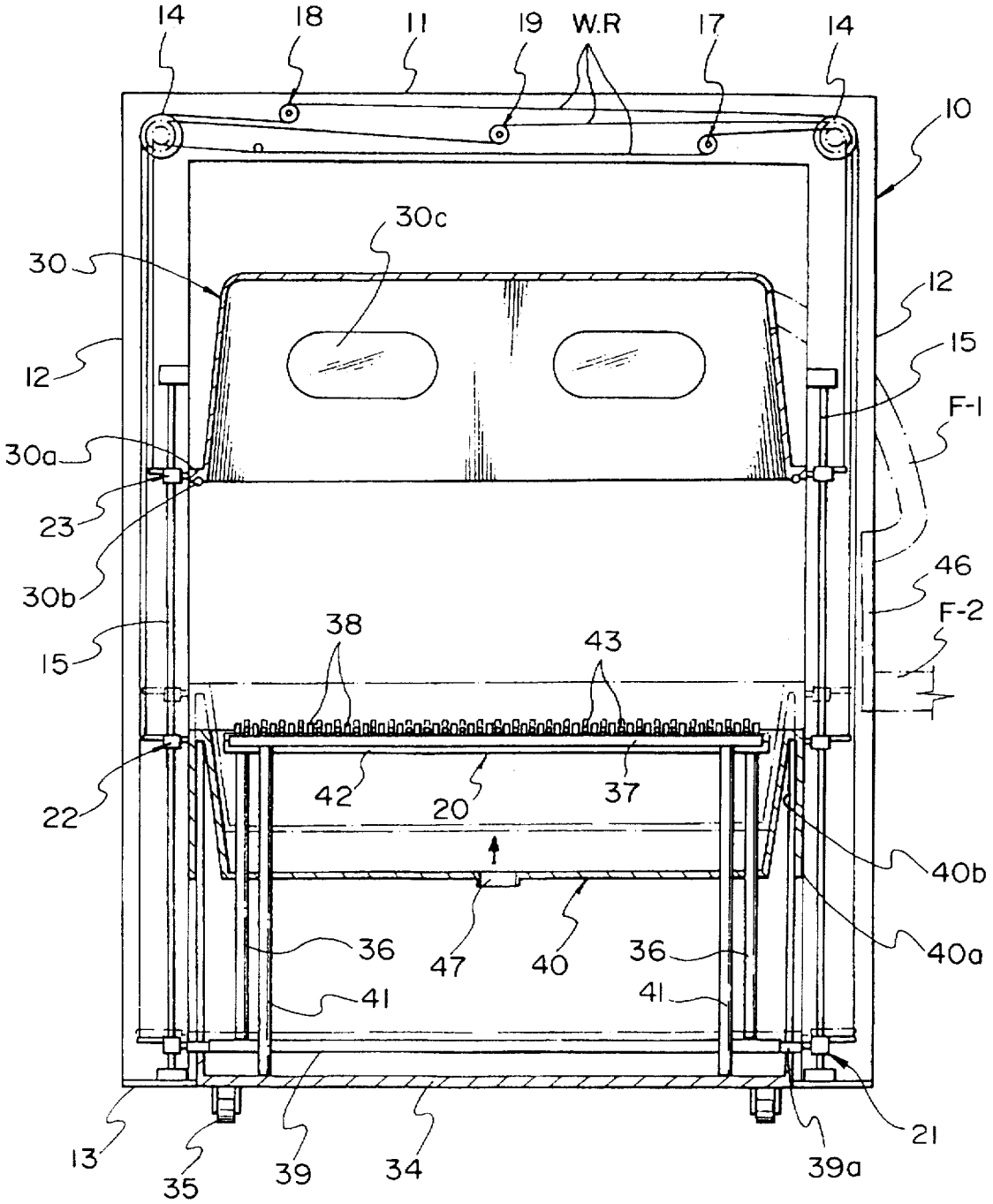
FIG. 3 is a sectional view of the above system, showing the vertical movement of a bathing tank.
Figure 4:
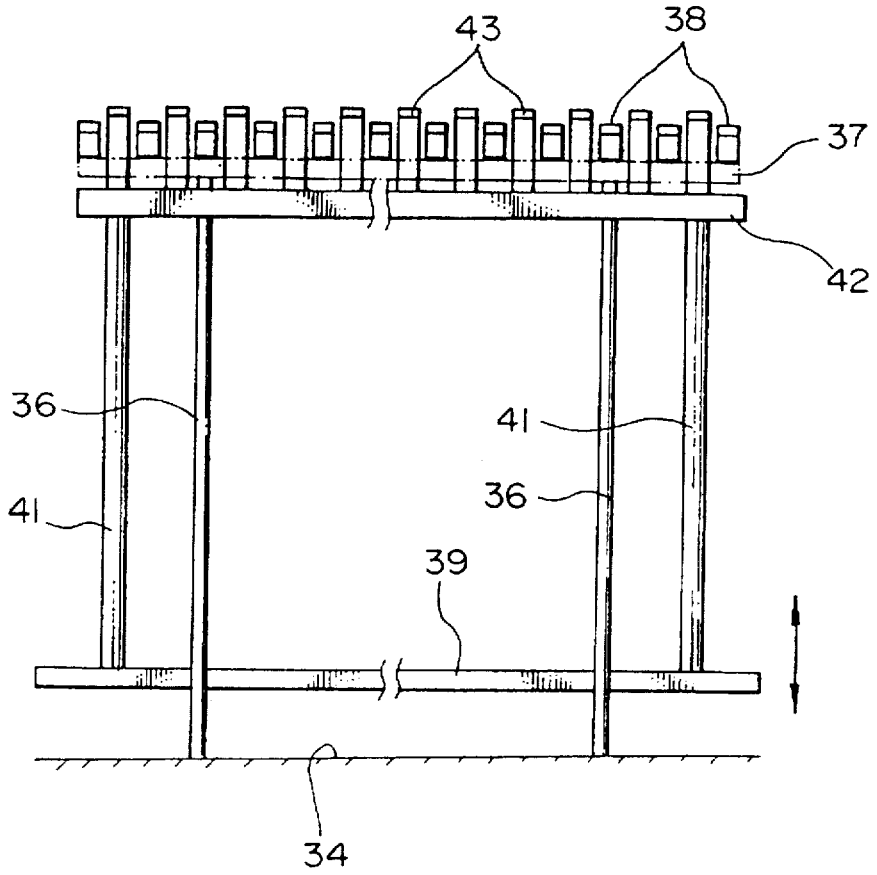
FIG. 4 is an enlarged view showing a bed of the above system.

However, the bed structure of the invention almost completely prevents the burn sufferers from getting such sores. That is, the fixed bars 38 are mounted on the horizontal rods 37 such that the bars 38 are spaced out at regular intervals thereby forming the fixed bed surface with regularly-spaced slits. In addition, the partition bars 43 are fixed to horizontal bars 42 thereby forming the additional bed surface. The above partition bars 43 are placed between the fixed bars 38 such that the normal position of the additional bed surface is lower than the fixed bed surface formed by the fixed bars 38. Furthermore, there are gaps between the fixed bars 38 and partition bars 43 thus allowing the air supplied from the unit 50 to easily ventilate in the bed 20. The above additional bed surface formed by the partition bars 43 can be lifted up by lifting the partition bars 43 in order to be higher than the fixed bed surface. In this case, so the body portions of the burn sufferer contacting with the bed surface is changed. The burn sufferer who ought to be in bed for a long time on one's wounds is thus protected from sores on the wounds. The above bed 20 is operated as follows. That is, the bed drive unit 18 is started by operating the control board C.B as shown in FIG. 3. The drive motor M of the above drive unit 18 is thus rotated to generate the rotating force. The rotating force of the motor M is transmitted to the worm wheel 27 through the worm shaft M-1 gearing into the worm wheel 27. The above worm wheel 27 is thus rotated about the central shaft 27*a*.

In this case, the driven wheels 29 fixed to both ends of the above central shaft 27*a* are rotated at the same time. The rotating motion of the above driven wheels 29 causes the eccentric connection members 29*a* to be eccentrically rotated. The wire ropes W.R connected to the above eccentric connection members 29*a* are pulled up simultaneously by the rotating motion of the above members 29*a*.

The lifting motion of the wire rope W.R causes the bed guider 21 to be operated in the same manner as described for the sealing cap guider 23. That is, the operating plate 39 connected to the connection rods 25 of the sliding blocks 25 is lifted up. The plate 39 thus lifts up the operating rods 41, horizontal bars 42 and partition bars 43. The additional bed surface formed by the partition bars 43 are thus lifted up to be higher than the fixed bed surface formed by the fixed bars 38. The additional bed surface instead of the fixed bed surface thus holds the burn sufferer. Therefore, the contacting portions of the burn sufferer's skin is changed thereby almost completely protecting the burn sufferer from getting blood poisoning.

In order to return the lifted partition bars 43 to the original position, the bed drive unit 18 is operated to move the bars 43 down. In this case, the bed surface for holding the burn sufferer is changed from the additional bed surface formed by the partitions bars 43 to the fixed bed surface formed by the fixed bars 38.

Of course, the operation of the bed 20 for changing the bed surface should be intermittently carried out under the control of the control board C.B while changing the interval of the operation in accordance with conditions of the burn sufferers.

In order to promote regeneration of the burnt tissue of the burn sufferers, the burn sufferers are preferably subjected to water massage to smooth blood circulation. The treating system of this invention allows the burn sufferer to be directly subjected to the water massage while continuously lying in bed 20. That is, the system of this invention does not require the burn sufferers to be put into the bath tank while getting a water massage. Therefore, the system maximizes the treating effect. In this case, the control board C.B is operated to lift the sealing cap 30 up by the cap drive unit 17 thereby opening the bed 20 as shown in FIG. 3. Thereafter, the bathing tank drive unit 19 is operated in the same manner as described for the cap drive unit 17.

When the above drive unit 17 is operated, the drive motor M is rotated. The rotating force of the motor M is transmitted to the worm wheel 31 through the worm shaft M-1 gearing into the worm wheel 31. The worm wheel 31 thus rotates the take-up drum 32, thereby winding the wire rope W.R and lifting the sliding blocks 25 of the guider 22 up. The bathing tank 40, which is connected to the connection rods 25*a* of the sliding blocks 25 on its bent edge 40*a*, is thus lifted up by the lifting motion of the sliding blocks 25 until the position of the bathing tank 40 is higher than the bed surface.

Thereafter, the air and water treating and supplying unit 50 is started. Water is thus introduced into the unit 50 through the water inlet pipe 57 and in turn passes the water filters in order of first to third filters 58, 59 and 60 thereby being purified. The purified water in turn is heated by the heater 61 and adjusted by the mixing valve 62 thereby becoming warm water having an appropriate temperature. Thereafter, the warm water is sprayed to wounds through the shower system 64 at an appropriate cycle controlled by the massage cycler 63. In order to use acid water in accordance with conditions of the burn sufferer, the acid water of the acid water tank 65 is pumped up by the pump 66 prior to being treated by the heater 61, mixing valve 62 and massage cycler 63. The acid water is thus sprayed to wounds through the shower system 64.

The above treating system allows a burn sufferer to be subjected to water massage and bathing while comfortably lying in the capsuled bed 20 differently from the conventional pressured clean isolation with several facilities. The treating system thus maximizes the treating effect.

As shown in FIG. 5, each of the fixed bars 38 and partition bars 43 comprises the separating bar 45 which is detachably assembled with the holding bar 44. In this regard, the separating bar 45 is separated from the holding bar 44 in order to wash and disinfect the bars 38 and 43 as demands. The above bars 38 and 43 are thus kept clean. In addition, the top surface of each separating bar 45 is smoothly rounded thereby minimizing the pressure between wounds and bed surface.

As wounds of burn sufferers are apt to lose much moisture, it is required to repeatedly check the weight of burn sufferers while treating.

Figure 10:
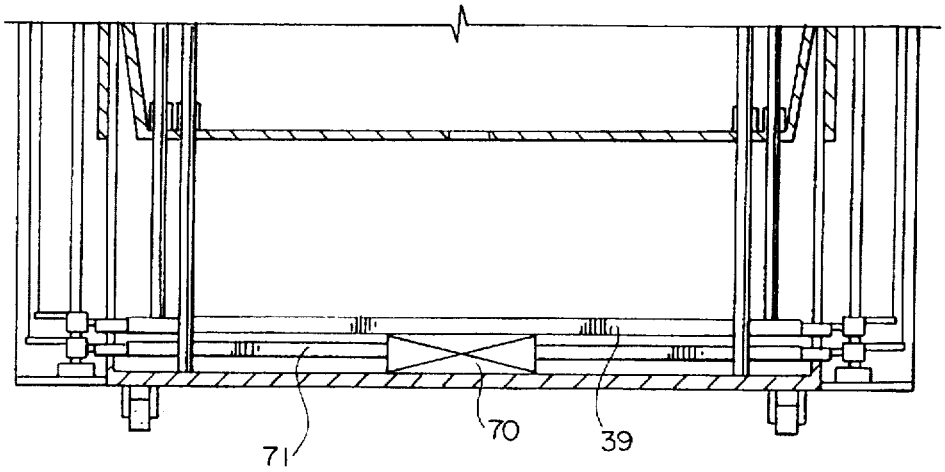
FIG. 10 is a view showing a treating system in accordance with another embodiment of the present invention.

In order to repeatedly check the weight of burn sufferers while treating, a weight meter 70 may be installed on the bottom of the operating plate 39 in accordance with another embodiment of the present invention. The construction of the above embodiment is shown in FIG. 10. The above weight meter 70 is held by support plates 71 which are connected to both sides of the above meter 70. The above support plates have the same mechanisms as those of the above-mentioned drive units and guiders thereby cooperating with the above units and guiders in order to be moved vertically. As the above weight meter 70 holds the operating plate 39, the weight of a burn sufferer lying in bed 20 is directly checked by the above weight meter 70.

Figure 11:
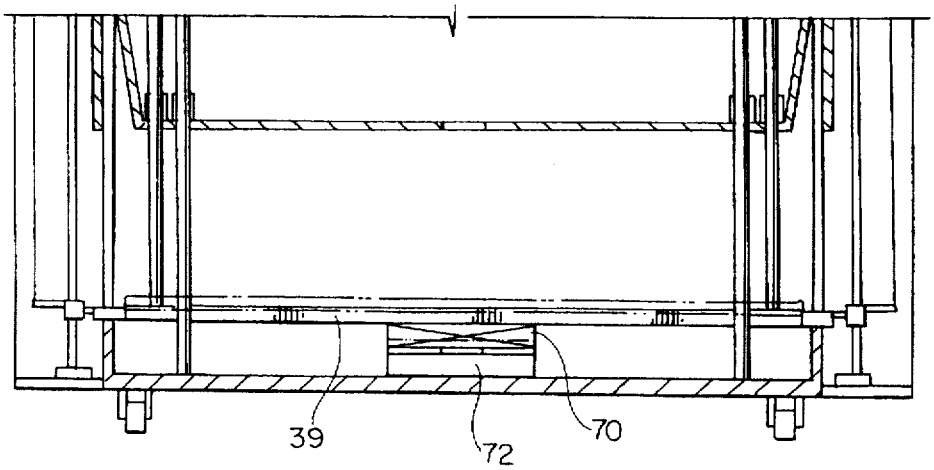
FIG. 11 is a view showing a treating system in accordance with a further embodiment of the present invention.

In accordance with a further embodiment of the present invention, a hydraulic or pneumatic cylinder 72 may be provided under the weight meter 70 as shown in FIG. 11. In this embodiment, the weight meter 70 holds the operating plate 39 by the operation of the above cylinder 72 thereby checking the weight of a burn sufferer.

Both the holder 10 and the air and water treating and supplying unit 50 of the above treating system are provided with casters 35 thereby being easily moved as demands. With the above casters 35, the above treating system effectively uses space.

As described above, the present invention provides a system for treating burn sufferers which capsules the pressured clean isolation into a compact size of a conventional medical bed. The above system is easily installed and moved at any time to any place without being restricted by time and space thereby being convenient to the users and reducing the cost for installing and managing the system. The above treating system achieves compactness and lightness of the facilities of the pressured clean isolation, such as the air cleaning system, room warming system, room cooling system, humidity controller, anti-sore bed and bathing tank, and organically connects the facilities to each other. The system thus structurally composes the facilities of the pressured clean isolation into a simple and compact structure and maximizing the operational reliability.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A system for treating burn sufferers comprising:

a rectangular holder having a top frame, a pair of side frames and a bottom support panel;

a first drive means operably coupled to said rectangular holder;

a bed horizontally placed between said side frames, said bed having a fixed bed surface and movable bed surface, said fixed and movable bed surfaces alternatively holding a burn sufferer, said movable bed surface being operably coupled to and selectively moved by said first drive means thereby being selectively lifted up higher than the fixed bed surface;

a second drive means operably coupled to said rectangular holder;

a movable sealing cap movably mounted to said holder for selectively sealing said bed and thereby capsuling the bed, said sealing cap being operably coupled to and vertically moved by said second drive means;

a third drive means operably coupled to said rectangular holder;

a movable bathing tank placed under said bed and operably coupled to and selectively vertically moved by said third drive means; and an air and water treating and supplying unit connected to said sealing cap and adapted for supplying both clean air with the appropriate temperature and humidity and purified water for the bed sealed by said sealing cap.

2. The treating system according to claim 1, wherein said first to third drive means comprises:

a three-stepped guide roll fitted over a shaft inside the top end of each side frame of the holder;

a plurality of drive units, that is, a bed drive unit, sealing cap drive unit and a bathing tank drive unit, placed in said top frame of the holder, the vertical positions of said drive units in the top frame being different from each other;

a pair of guide rods vertically standing on the bottom support panel of the holder upward and extending in each side frame such that the rods are spaced apart from and parallel with each other;

a plurality of guiders, that is, a bed guider, sealing cap guide and bathing tank guider, movably coupled to said guide rods, each guider including:

a pair of horizontal connection bars;

a pair of sliding blocks mounted to both ends of each connection bar, said sliding blocks being movably fitted over said guide rods; and a plurality guide brackets provided on said connection bars at different portions of the bars, respectively; and a plurality of wire ropes wrapped about said guide rolls and passing over the drive units and extending to said guide brackets of the connection bars, respectively.

3. The treating system according to claim 1 or 2, wherein a pair of longitudinal guide holes are formed on each side frame of the holder, while the sliding blocks of said guiders are provided with connection rods, said connection rods passing the guide holes of the side frames and being connected to said bed, sealing cap and bathing tank.

4. The treating system according to claim 1 or 2, wherein said bed drive unit comprises:

a drive motor;

a worm wheel gearing into a worm shaft of said drive motor and held between a pair of fixed bearings by a central shaft; and a pair of driven wheels fixed to both ends of said central shaft, each driven wheel having an eccentric connection member, said connection member being connected to a wire rope extending to said bed guider.

5. The treating system according to claim 1 or 2, wherein each of said sealing cap and bathing tank drive units comprises:

a drive motor;

a take-up drum partitioned into two parts; and a worm wheel gearing into a worm shaft of said drive motor and held between a pair of fixed bearings by a central shaft, and fixed to one side of said drum thereby winding or unwinding the wire rope on or from said take-up drum.

6. The treating system according to claim 1, wherein said bathing tank is seated on and held by a protection tub on a seat groove formed by a bent edge of said bathing tank, said protection tub fixedly provided on said bottom support panel of the holder and provided with casters on its four corners, said bathing tank bent edges having side portions connected to the connection rods of the sliding blocks of the bathing tank guider.

7. The treating system according to claim 6, wherein said bed comprises:

a plurality of vertical rods extending from the bottom of said protection tub upward and penetrating the bottom of the bathing tank;

a plurality of horizontal rods connecting the top ends of said vertical rods together;

a plurality of fixed bars mounted to said horizontal rods and spaced out at regular intervals thereby forming said fixed bed surface with regularly-spaced slits;

a plurality of partition bars fixed to horizontal bars thereby forming said movable bed surface with regularly-spaced slits, said partition bars being placed between said fixed bars such that a normal vertical position of the movable bed surface is lower than the fixed bed surface, said horizontal bars being connected to operating rods standing on an operating plate;

the operating plate mounted to an inner bottom of said protection tub; and a plurality of protrusions provided on the corners of said operating plate, said protrusions passing through guide slots formed on both sides of said protection tub and in turn connected to the connection rods of the sliding blocks of the bed guider.

8. The treating system according to claim 1, wherein each of said fixed bars and partition bars comprises a separating bar and holding bar detachably assembled together.

9. The treating system according to claim 1 or 2, wherein said air and water treating and supplying unit comprises:

a movable housing having casters on its bottom and an outlet port connected to a bellows pipe, said bellows pipe extending to said sealing cap;

a blower forcibly circulating external air toward said outlet port;

first and second air filters adapted for filtering the external air flowing toward the outlet port;

an air heater adapted for heating the external air while the air passes through the air filters;

a humidity controller adapted for controlling air in order to give the appropriate humidity to the air;

a water inlet pipe;

first to third water filters connected to said water inlet pipe and repeatedly filtering water supplied thereto through the water inlet pipe;

a water heater adapted for heating purified water coming out of said water filters;

a mixing valve adapted for adjusting heated purified water thereby providing warm water having an appropriate temperature;

a massage cycler adapted for supplying the warm water to a shower system at an appropriate cycle;

an acid water tank adapted for supplying acid water; and a pump connected to a water supply line extending from said third water filter, said pump being also connected to said acid water tank for pumping up the acid water.

10. The treating system according to claim 1, further comprising a weight meter adapted for checking the weight of the burn sufferer while treating, said weight meter being installed on the bottom of the operating plate in order to hold the operating plate.

11. The treating system according to claim 7, further comprising a weight meter adapted for checking the weight of the burn sufferer while treating, said weight meter being installed on the bottom of the operating plate in order to hold the operating plate.

12. The treating system according to claim 1, wherein said bed comprises:

a plurality of vertical rods operably supported by said bottom support panel and extending upward and penetrating the bottom of the bathing tank;

a plurality of horizontal rods connecting the top ends of said vertical rods together;

a plurality of fixed bars mounted to said horizontal rods and spaced out at regular intervals thereby forming said fixed bed surface with regularly-spaced slits;

a plurality of partition bars fixed to horizontal bars thereby forming said movable bed surface with regularly-spaced slits, said partition bars being placed between said fixed bars such that a normal vertical position of the movable bed surface is lower than the fixed bed surface, said horizontal bars being connected to operating rods standing on an operating plate;

the operating plate operably mounted to said bottom support panel; and a plurality of protrusions provided on the corners of said operating plate, said protrusions connected to the connection rods of the sliding blocks of the bed guider.

* * * * *